US009890646B2

(12) United States Patent
Krueckels et al.

(10) Patent No.: US 9,890,646 B2
(45) Date of Patent: Feb. 13, 2018

(54) INTERNALLY COOLED AIRFOIL FOR A ROTARY MACHINE

(71) Applicant: ALSTOM Technology Ltd, Baden (CH)

(72) Inventors: Joerg Krueckels, Birmenstorf (CH); Brian Kenneth Wardle, Brugg-Lauffohr (CH); Herbert Brandl, Waldshut-Tiengen (DE); Marc Widmer, Winterthur (CH)

(73) Assignee: ANSALDO ENERGIA IP UK LIMITED, London (GB)

( * ) Notice: Subject to any disclaimer, the term of this patent is extended or adjusted under 35 U.S.C. 154(b) by 287 days.

(21) Appl. No.: 14/625,734

(22) Filed: Feb. 19, 2015

(65) Prior Publication Data

US 2015/0159490 A1 Jun. 11, 2015

Related U.S. Application Data

(63) Continuation of application No. PCT/EP2013/067227, filed on Aug. 19, 2013.

(30) Foreign Application Priority Data

Aug. 20, 2012 (EP) ..... 12180953

(51) Int. Cl.
*F01D 5/18* (2006.01)
*F01D 9/02* (2006.01)
*B22C 9/24* (2006.01)

(52) U.S. Cl.
CPC ..... *F01D 5/189* (2013.01); *B22C 9/24* (2013.01); *F01D 5/186* (2013.01); *F01D 9/02* (2013.01);

(Continued)

(58) Field of Classification Search
CPC . F01D 5/18; F01D 5/186; F01D 5/187; F01D 5/188; F01D 5/147; F05D 2230/21; F05D 2230/211; B22C 9/24
See application file for complete search history.

(56) References Cited

U.S. PATENT DOCUMENTS 3,301,527 A 1/1967 Kercher
3,540,810 A * 11/1970 Kercher ..... F01D 5/189 415/115

(Continued)

FOREIGN PATENT DOCUMENTS

CA 813148 A 5/1969
CN 1629450 A 6/2005

(Continued)

OTHER PUBLICATIONS

Notification of Reasons for Refusal dated May 22, 2017 in corresponding Japanese Patent Application No. 2015-527882, and an English translation thereof.

(Continued)

*Primary Examiner* — Woody Lee, Jr.
*Assistant Examiner* — Topaz L Elliott
(74) *Attorney, Agent, or Firm* — Buchanan Ingersoll & Rooney PC

(57) ABSTRACT

An internally cooled airfoil for a rotary machine, for example, a gas turbine engine includes a suction and pressure side wall each extending in an axial direction, i.e. from a leading to a trailing edge of the airfoil. A suction wall sided cooling channel and a pressure wall sided cooling channel extend in the axial direction. A feed chamber is defined between a first and second inner wall for feeding the suction wall and pressure wall sided cooling channel each by at least one through hole inside of the first and second inner wall. The suction wall sided cooling channel and the pressure wall sided cooling channel extend into the trailing edge region (Continued)

separately. The suction wall sided cooling channel and the pressure wall sided cooling channel join before discharging at the trailing edge.

11 Claims, 3 Drawing Sheets

(52) U.S. Cl.
CPC .. *F05D 2260/201* (2013.01); *F05D 2260/202* (2013.01)

(56) References Cited

U.S. PATENT DOCUMENTS

| | | | | | |
|---|---|---|---|---|---|
| 3,628,880 | A | * | 12/1971 | Smuland | F01D 5/189 415/115 |
| 3,809,494 | A | * | 5/1974 | Redman | F01D 5/189 415/115 |
| 3,930,748 | A | * | 1/1976 | Redman | F01D 5/189 415/115 |
| 4,021,139 | A | * | 5/1977 | Franklin | F01D 5/189 415/115 |
| 4,697,985 | A | * | 10/1987 | Suzuki | F01D 5/189 415/115 |
| 5,328,331 | A | | 7/1994 | Bunker et al. | |
| 5,720,431 | A | | 2/1998 | Sellers et al. | |
| 6,000,908 | A | * | 12/1999 | Bunker | F01D 5/189 165/908 |
| 6,379,118 | B2 | | 4/2002 | Lutum et al. | |
| 7,946,815 | B2 | | 5/2011 | Liang | |
| 2003/0049127 | A1 | | 3/2003 | Tiemann | |
| 2005/0244264 | A1 | | 11/2005 | Jacks et al. | |
| 2011/0135497 | A1 | * | 6/2011 | Marmilic | F01D 5/14 416/97 R |
| 2011/0171023 | A1 | * | 7/2011 | Lee | F01D 5/187 416/1 |

FOREIGN PATENT DOCUMENTS

| | | | |
|---|---|---|---|
| CN | 1766290 | A | 5/2006 |
| CN | 101131095 | A | 2/2008 |
| EP | 1 267 038 | B1 | 5/2006 |
| EP | 2 333 240 | A1 | 6/2011 |
| GB | 1 322 801 | A | 7/1973 |
| JP | 44-8527 | | 4/1969 |

OTHER PUBLICATIONS

Fifth Office Action dated Sep. 18, 2017 in corresponding Chinese Patent Application No. 201380043934.7, and an English translation thereof.

* cited by examiner

INTERNALLY COOLED AIRFOIL FOR A ROTARY MACHINE

CROSS-REFERENCE TO RELATED APPLICATIONS

This application claims priority to PCT/EP2013/067227 filed Aug. 19, 2013, which claims priority to European application 12180953.7 filed Aug. 20, 2012, both of which are hereby incorporated in their entireties.

TECHNICAL FIELD

The present invention relates to an internally cooled airfoil for a rotary machine, preferably a gas turbine engine. Such airfoils, regardless of whether they are used as a vane or blade, typically comprise a suction side wall and a pressure side wall each extending in an axial direction, i.e. from a leading to a trailing edge region of said airfoil. Among the known airfoils those airfoils are of interest which have at least one suction wall sided cooling channel, extending in axial direction confined by the suction side wall and a first inner wall, and at least one pressure wall sided cooling channel, extending in axial direction confined by the pressure side wall and a second inner wall. Further at least one feed chamber is defined between said first and second inner wall for feeding said at least one suction and pressure sided cooling channel each by at least one through hole inside of said first and second inner wall.

BACKGROUND

It is known practice for selected gas turbine engine components, especially in the turbine section, to be internally air cooled by a supply of air bleed from a compressor offtake. Such cooling is necessary to maintain component temperatures within the working range of the materials from which they are constructed. Higher engine gas temperature have led to increased cooling bleed requirements resulting in reduced cycle efficiency and increased emission levels.

To date, it has been possible to improve the design of cooling systems to minimize cooling flow at relative low cost. In the future, engine temperatures will increase to levels at which it is necessary to have complex cooling features to maintain low cooling flows.

An effective cooling system of blades for a gas turbine engine is disclosed in U.S. Pat. No. 5,720,431. The disclosed airfoil includes a double wall configuration in the mid-chord region with a plurality of radial feed passages defined on each side of the airfoil between the inner wall and the outer wall. A central radially extending feed chamber is defined between the two inner walls. A trailing edge of the airfoil includes a conventional single wall configuration with two outer walls defining a sequence of trailing edge cavities extending radially through the airfoil and being axially connected fluidly such that a common exhaust port discharge at the trailing edge directly. Due to the bent airfoil profile there is a large material accumulation at the end of the pressure side cavity which leads to a higher temperature gradient in the airfoil.

The same negative aspect of material accumulation at the pressure sided trailing edge region of an airfoil can be observed at the known air cooled airfoil disclosed in EP 1 267 038 B1. The herein described airfoil provides an axially orientated suction sided near wall channel which discharges its cooling air at the trailing edge towards the pressure side. As the trailing edge is subject to a very high heat load, the suction side cooling channel has to provide sufficient air to keep the trailing edge temperatures sufficiently low.

Another design for internally cooling an airfoil for gas turbine engine is disclosed in U.S. Pat. No. 7,946,815 B2 which provides near wall cooling channels to keep the wall temperatures low enough to provide sufficient component life. Separate channels at the pressure side and the suction side are for cooling the outer side of the airfoil which is exposed to the hot gas flow in a gas turbine stage. The known airfoil disclosed in the before document comprises a suction and a pressure side wall each extending in an axial direction, which means from a leading to a trailing edge region of the airfoil. The known airfoil further comprises a suction wall sided cooling channel extending in axial direction confined by a suction side wall and a first inner wall, as well a pressure wall sided cooling channel extending in axial direction confined by the pressure side wall and a second inner wall. The first and second inner wall borders some feed chambers, some of them are fluidly connected, for feeding said at least one suction and pressure sided cooling channel with a cooling medium, preferably compressed air each by a multitude of through holes inside of said first and second inner wall.

SUMMARY

It is an object of the invention to provide an internally cooled casted airfoil for a rotary machine, preferably a gas turbine engine comprising the features as discussed before by referring to the document U.S. Pat. No. 7,946,815 B2 as the closest state of the art wherein the cooling especially in the trailing edge region shall be enhanced by avoiding a huge material accumulation especially at the pressure sided wall to avoid any further stresses.

A further object is to enhance balancing of pressure side and suction side cooling of the airfoil considering the necessity for sufficient air for good cooling at the trailing edge and pressure side bleed.

A further object is to take care of molding aspects so that the airfoil shall be produced by molding without the need of complex and expensive core constructions.

An inventive internally cooled casted airfoil for a rotary machine, preferably a gas turbine engine is characterized in that at least one suction wall sided cooling channel and that at least one pressure wall sided cooling channel extend into the trailing edge region separately and that at least one suction wall sided cooling channel and that at least one pressure wall sided cooling channel join before discharging at the trailing edge.

Basically the inventive concept of the airfoil can be applied to airfoils in compressor units, gas and steam turbine stages. In the following the application in gas turbines are explained in more detail without limiting the scope of the invention.

In a preferred embodiment the at least one suction wall sided cooling channel and the at least one pressure wall sided cooling channel join at a common channel region which joins a discharge channel which opens to the pressure side at the trailing edge. Due to the fact that the at least two separately guided cooling flows one along the at least one suction wall sided cooling channel and the other along the pressure wall sided cooling channel will merge in the common channel region before escaping through the discharge channel at the trailing edge region, a significant positive effect on balancing of pressure side and suction side cooling is connected thereto. So it is a matter of fact that fluid dynamics of the at least two separate guided cooling flows will influence each other. Since the pressure sided trailing edge region is subjected to a very high heat load during operation in a gas turbine stage the inventive reunion of the at least two suction and pressure wall sided cooling channels results in a sufficient air supply for good cooling of the trailing edge and the pressure side bleed.

To avoid thermal stresses inside material regions of the airfoil especially at the trailing edge region the suction side wall and the pressure side wall are each of constant wall thickness preferably along the axial extension, except the region of the discharge channel, along which the wall thickness becomes smaller at least of one of the suction or pressure side walls. As it will be explained in the following it can be of advantage to vary the thickness of the pressure and suction side wall in radial direction which is perpendicular to the axial extension of the airfoil. In a further preferred embodiment the airfoil contains at least two, preferably three or more separate suction wall sided cooling channels which are arranged by a radial distance. Each of the suction wall sided cooling channels are confined by the suction wall and the first inner wall. In the same way the airfoil contains at least two, preferably three or more pressure wall sided cooling channels which are also arranged by a radial distance. Like in case of the suction wall sided cooling channels the radial distance between two neighboring cooling channels shall be constant but may vary also to comply with an optimized strategy of cooling the airfoil.

The number of radially separated cooling channels at the pressure and suction side wall is equal but preferably, may differ from each other to comply with specific optimized cooling strategies.

By providing a plurality of near wall cooling channels at the suction side wall and the pressure side wall which are separated radially and combine in pairs at the common channel region, which is formed as a continuous cavity in radial direction inside the airfoil, opens up the possibility of producing the airfoil in a casting process with a significantly enhanced robustness. The casting core provides a stable uniform displacement body which consists of a main body for building the continuing cavity for the common channel region. Further aspect will be described in connection with corresponding illustration shown in the figures.

A further important aspect of the inventive internally cooled airfoil concerns the design of the first and second inner wall which border the suction and pressure wall sided cooling channels inside of the airfoil. In a preferred embodiment the first and second inner wall are designed in the common channel region such that the cross-sectional area of the suction wall sided cooling channel becomes larger while the cross-sectional area of the pressure wall sided cooling channel remains constant before joining. In any case of design it is a main motivation to keep the thickness of the walls bordering the cooling channels at the trailing edge region of the airfoil as small as possible to avoid material accumulation so that thermal stresses can be reduced significantly.

The cooling effect which is achieved by a high pressurized air flow directed through the corresponding cooling channels is based on convective cooling. To enhance convective cooling it is favorable to reduce the flow cross-sectional area at least locally to keep the cooling flow velocity and combined herewith the heat transfer coefficient as high as possible. Under this aspect a further preferred embodiment provides in the common channel region at least one pin which connects the suction and the pressure side wall facing each other directly. Since the common channel region represents a large continuing cavity having a radial extension and combining a multitude of radially separated cooling channels inside the pressure and suction side wall, a multitude of pins is provided within said common channel region forming a so called pin field rendering a flow obstruction through which the cooling flows are accelerated locally.

A further action to enhance convective cooling along the cooling channels and especially at the common channel region concerns the placement of at least one axial rib which may be arranged along at least one of the suction or pressure wall sided cooling channels for reducing the cross-sectional area of the cooling channels respectively. The at least one axial rib is preferably arranged in the common channel region where the at least one suction wall sided cooling channel and the at least one pressure sided cooling channel join.

BRIEF DESCRIPTION OF THE DRAWINGS

The invention shall subsequently be explained in more detail based on exemplary embodiments in conjunction with the drawing. In the drawing

DETAILED DESCRIPTION

Figure 1:
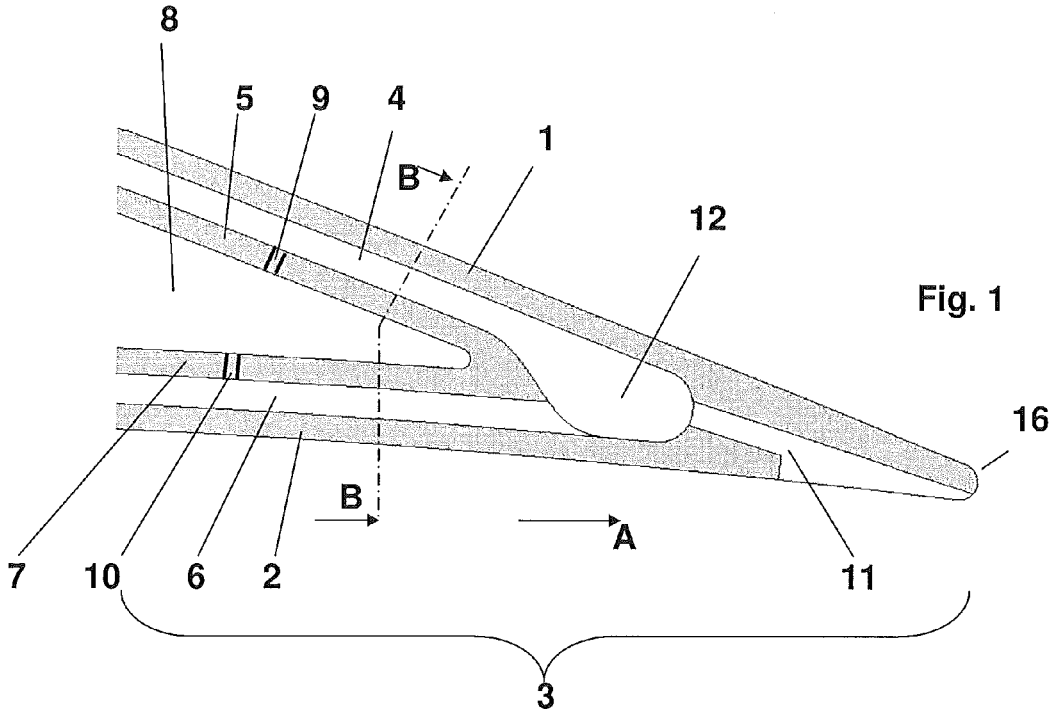
FIG. 1 shows schematically a section image of an inventive airfoil in the trailing edge region.

FIG. 1 shows a schematically section image of the trailing edge region 3 of an airfoil which provides a suction side wall 1 and a pressure side wall 2 extending in an axial direction A, which means from a leading edge which is not shown to the trailing edge 16. The suction wall 1 borders together with a first inner wall 5 a so called suction wall sided cooling channel 4, and further the pressure side wall 2 borders together with the second inner wall 7 the so called pressure wall sided cooling channel 6, both cooling channels 4, 6 merge together in a common channel region 12.

The first and second inner walls 5, 7 border a feed chamber 8 which is filled with compressed air which enters the suction and the pressure wall sided cooling channels 4, 6 by through holes 9, 10 (at least one through hole per wall is illustrated representing a multitude of such through holes). The common channel region 12 joins a discharge channel 11 which opens to the pressure side at the trailing edge 16.

Figure 2:
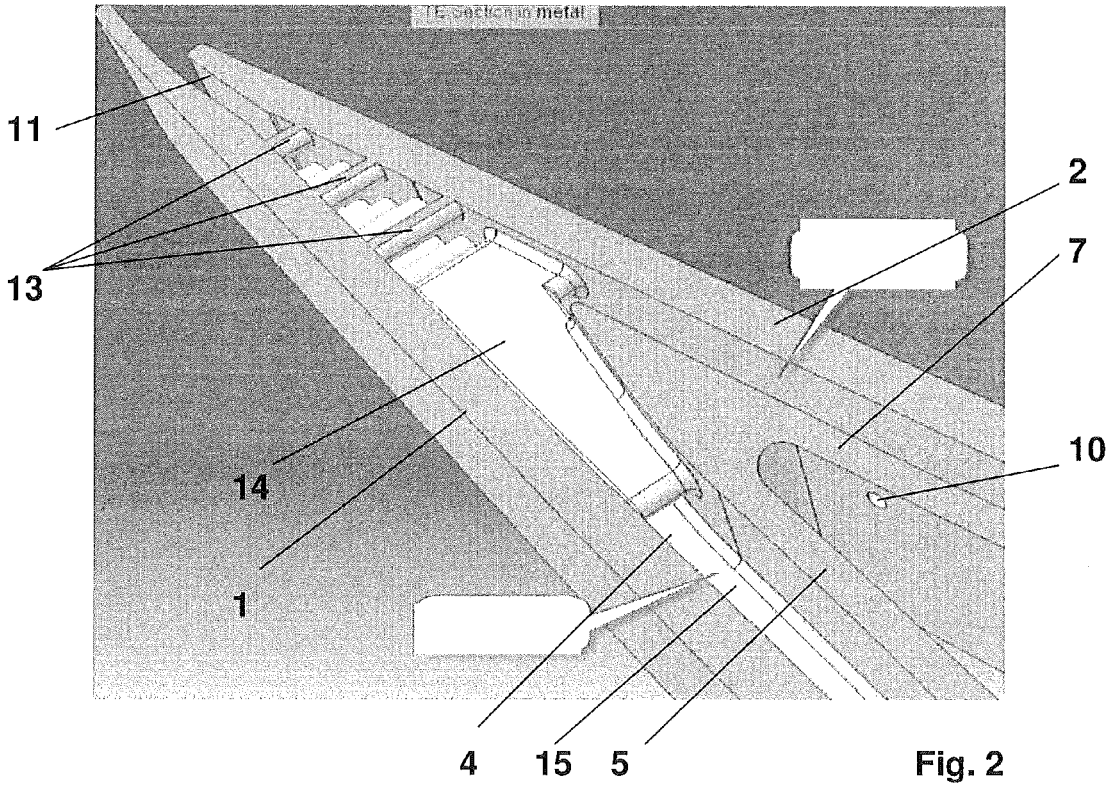
FIG. 2 shows a perspective view of the trailing edge region in a sectional view manner.
Figure 3:
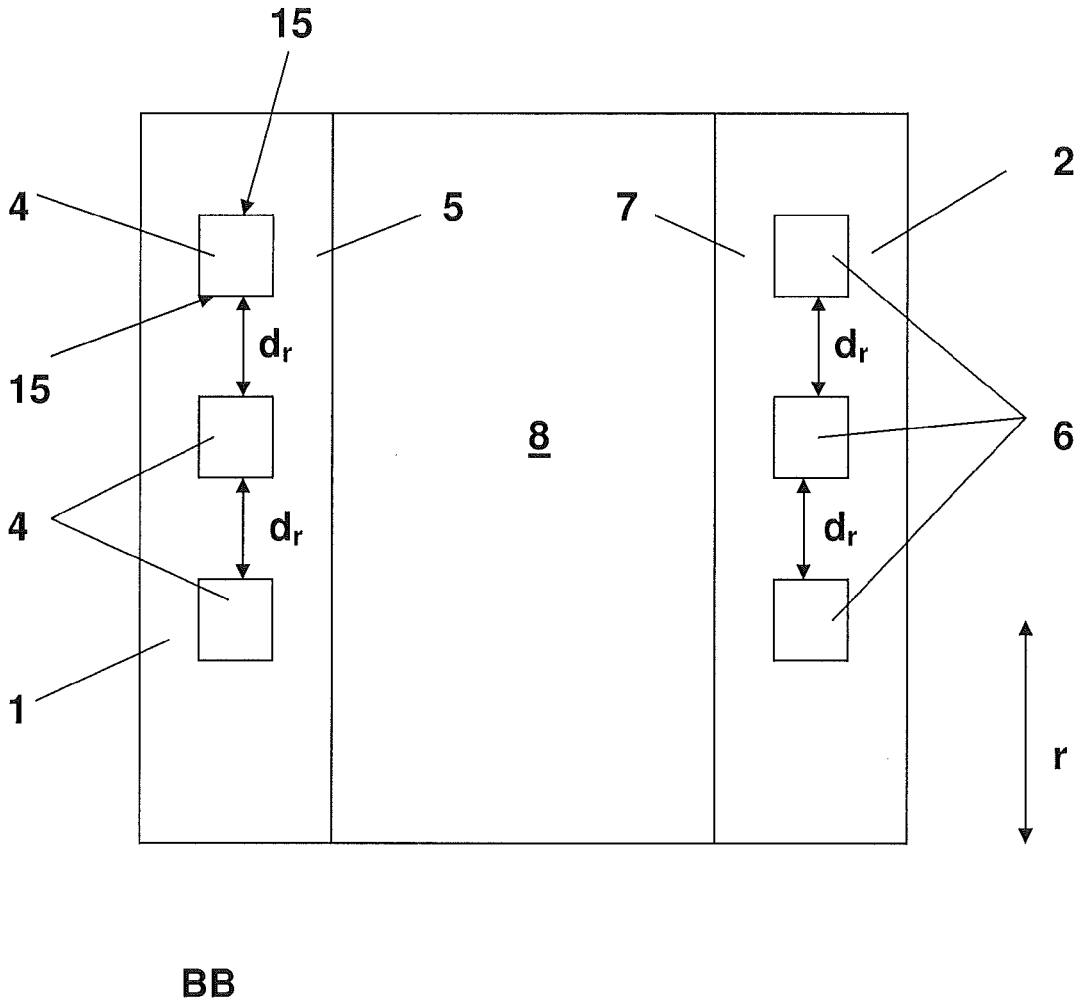
FIG. 3 shows a section view along section line BB.

The illustrated suction and pressure wall sided cooling channels 4, 6 are further separated radially which can be seen in more detail in FIG. 2 which shows a perspective view of a longitudinal cross-section through the trailing edge region 3. The embodiment shown in FIG. 2 provides an insight into the suction wall sided cooling channel 4 which is limited by a partition wall 15 radially downwards. As it will be explained in more detail in connection with FIGS. 4*a* and *b* the airfoil comprises more than one suction wall sided cooling channel as well more than one pressure wall sided cooling channel. FIG. 3 shows a partially section view along the section line BB, see FIG. 1, which illustrates the airfoil in radial direction r having three suction 4 and pressure wall sided cooling channels 6 which are arranged by a radial distance $d_r$ each confined by the suction 1 respectively pressure side wall 2 and the first respectively second inner wall 5, 7. All cooling channels 4, 6 being separated radially enter the common channel region 12 which extends radially for joining all of the radially separated cooling channels.

For purpose of an enhanced flow velocity there are some flow obstacles in the region of the flow channels as well in the region of the common channel region 12. To reduce the flow cross-sectional area inside a flow channel an axial rib 14 is provided extending into the suction wall sided cooling channel 4 and also into the common channel region 12. Further there are pins 13 which connect the inner wall side of the suction side wall 1 and the pressure side wall 2.

Further the first and second inner walls 5, 7 join each other in the common channel region 12 providing an aero-dynamic shaped flow contour which interacts with the cooling flows directed through each of the channels. The design of the first and second inner walls 5, 7 is optimized in view of material reduction, to avoid any thermal induced stresses.

Figure 4A:
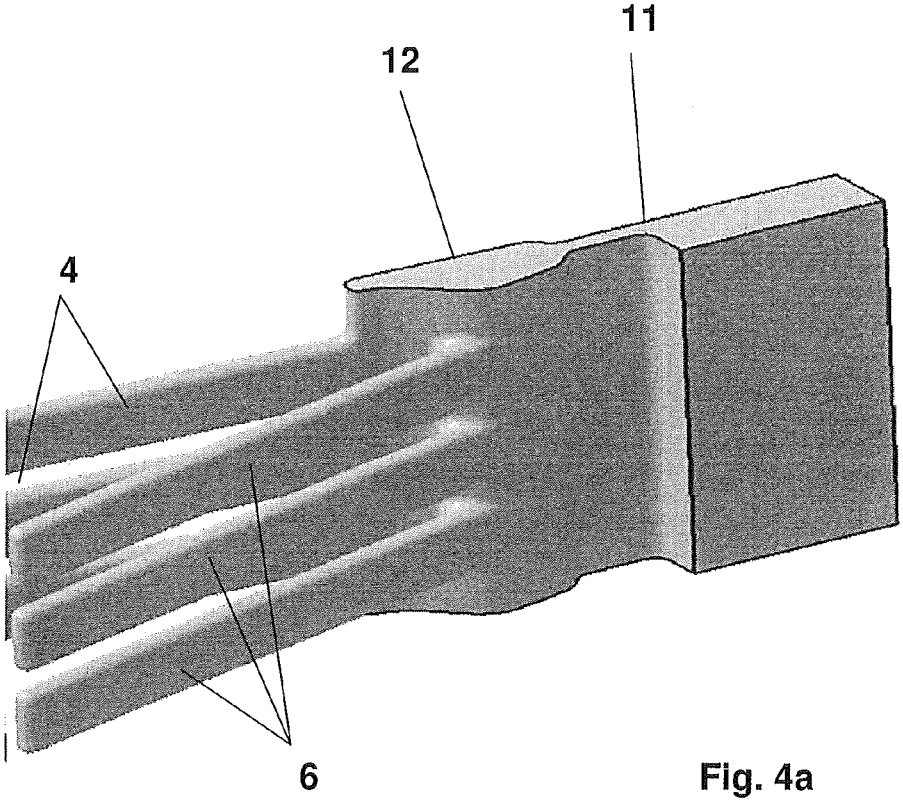
FIG. 4*a, b* illustrate three-dimensional views of two types of a casting core for producing the pressure and suction wall sided cooling channels, the common channel region and the discharge channel.
Figure 4B:
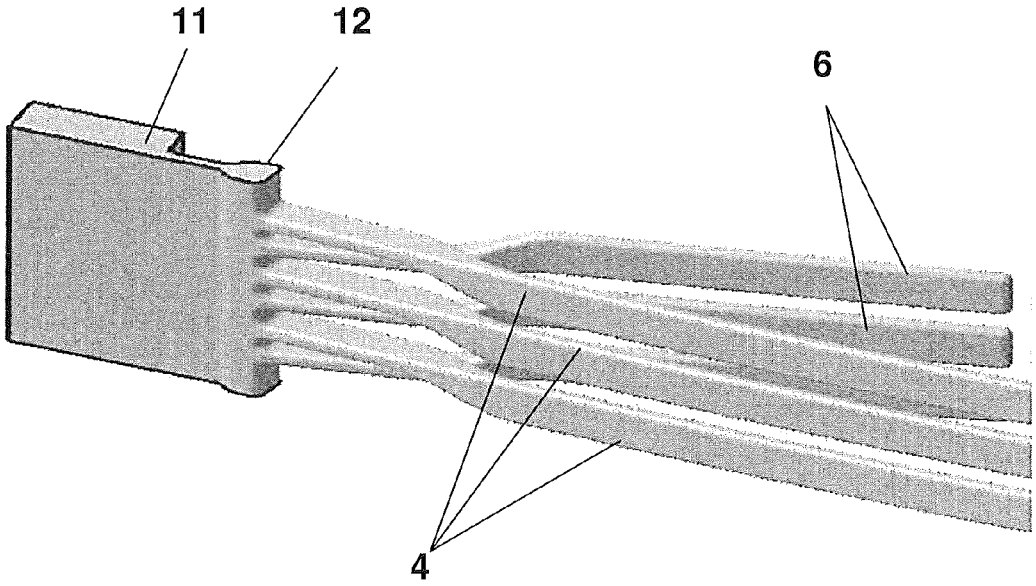

FIGS. 4*a* and *b* show casting cores for producing the cavities of the suction wall sided cooling channels 4, the pressure wall sided cooling channels 6, the common channel region 12 and the discharge channel 11. In both illustrated embodiments there are three radially separated suction and pressure wall sided cooling channels 4, 6 which enter commonly the common channel region 12 which is a unitary body with a continuous radial extension which is connected with the core region for producing the discharge channel 11 which also has a continuous radial extension.

The invention claimed is:

1. An internally cooled casted airfoil for a rotary machine, comprising:

a suction side wall and a pressure side wall each extending in an axial direction from a leading edge region to a trailing edge region of said airfoil;

at least one suction wall sided cooling channel extending in the axial direction confined by the suction side wall and a first inner wall;

at least one pressure wall sided cooling channel extending in the axial direction confined by the pressure side wall and a second inner wall; and at least one feed chamber being defined between said first and second inner wall for feeding a cooling fluid to said at least one suction and pressure sided cooling channel, each by at least one through hole inside of said first and second inner wall from the feed chamber toward a trailing edge, wherein said at least one suction wall sided cooling channel and said at least one pressure wall sided cooling channel extend into the trailing edge region separately, and said at least one suction wall sided cooling channel and said at least one pressure wall sided cooling channel join before discharging at the trailing edge, wherein at least one axial rib is arranged in a common channel region where the at least one suction wall sided cooling channel and the at least one pressure wall sided cooling channel join, the at least one axial rib extending from the suction side wall to the pressure side wall and partially into the suction wall sided cooling channel, a terminal end of the at least one axial rib nearest the leading edge terminating downstream of the at least one feed chamber in a coolant fluid flow direction.

2. The internally cooled casted airfoil according to claim 1, wherein the at least one suction wall sided cooling channel and the at least one pressure wall sided cooling channel join at the common channel region which joins a discharge channel open to the pressure side at the trailing edge.

3. The internally cooled airfoil according to claim 2, wherein the suction side wall and the pressure side wall are each of essentially constant wall thickness along the axial direction at least in the trailing edge region, except the region of the discharge channel, along which the wall thickness becomes smaller in at least of one of the suction or pressure side walls.

4. The internally cooled casted airfoil according to claim 2, comprising:

at least one pin arranged in the common channel region, the at least one pin connects the suction and the pressure side wall facing each other.

5. The internally cooled casted airfoil according to claim 2, wherein along the suction wall sided cooling channel, the at least one axial rib is arranged for reducing a cross-sectional area of the cooling channel respectively.

6. The internally cooled casted airfoil according to claim 2, wherein the first and second inner wall are designed in the common channel region such that the cross-sectional area of the suction wall sided cooling channel becomes larger while the cross-sectional area of the pressure wall sided cooling channel remains constant before joining.

7. The internally cooled casted airfoil according to claim 2, wherein at least two separate suction wall sided cooling channels are arranged by a radial distance each confined by the suction side wall and the first inner wall.

8. The internally cooled casted airfoil according to claim 7, wherein at least two separate pressure wall sided cooling channels are arranged by a radial distance each confined by the pressure side wall and the second inner wall.

9. The internally cooled casted airfoil according to claim 8, wherein the common channel region is in a form of a continuous cavity which has an axial and radial extension, into which the at least two separate pressure wall sided cooling channels and/or at least two separate suction wall sided cooling channels enter and at least one of the two suction wall sided cooling channels and at least one of the two pressure wall sided cooling channels join at a common channel region which joins a discharge channel open to the pressure side at the trailing edge.

10. The internally cooled casted airfoil according to claim 1, wherein the airfoil is used as vane and/or blade within a turbine stage of a gas turbine engine.

11. A gas turbine engine, comprising:

the internally cooled casted airfoil according to claim 1.

* * * * *